US009874362B2

(12) United States Patent
Douglas

(10) Patent No.: US 9,874,362 B2
(45) Date of Patent: Jan. 23, 2018

(54) SYSTEMS AND METHODS FOR VENTILATING A BUILDING

(71) Applicant: Lennox Industries Inc., Richardson, TX (US)

(72) Inventor: Jonathan Douglas, Lewisville, TX (US)

(73) Assignee: Lennox Industries Inc., Richardson, TX (US)

( * ) Notice: Subject to any disclaimer, the term of this patent is extended or adjusted under 35 U.S.C. 154(b) by 359 days.

(21) Appl. No.: 14/057,994

(22) Filed: Oct. 18, 2013

(65) Prior Publication Data

US 2015/0107817 A1 Apr. 23, 2015

(51) Int. Cl.

| | |
|---|---|
| ***F24F 7/02*** | (2006.01) |
| ***F24F 11/00*** | (2006.01) |
| ***F24F 11/04*** | (2006.01) |

(52) U.S. Cl.

CPC ..... *F24F 7/02* (2013.01); *F24F 11/0001* (2013.01); *F24F 11/001* (2013.01); *F24F 11/04* (2013.01); *F24F 2011/0002* (2013.01); *F24F 2011/0006* (2013.01); *F24F 2011/0042* (2013.01)

(58) Field of Classification Search

CPC ..... F24F 7/02
USPC ..... 454/255, 366
See application file for complete search history.

(56) References Cited

U.S. PATENT DOCUMENTS 4,217,243 A 8/1980 Christie
4,271,898 A 6/1981 Freeman
4,478,048 A 10/1984 Dills
4,478,056 A * 10/1984 Michaels, Jr. ..... F24F 1/022 165/250
4,534,181 A 8/1985 Brown
4,552,058 A * 11/1985 Wooldridge ..... F24F 3/1603 165/270
4,586,893 A 5/1986 Somerville et al.
5,180,102 A 1/1993 Gilbert et al.
5,447,037 A 9/1995 Bishop et al.
5,555,195 A 9/1996 Jensen et al.
5,559,407 A 9/1996 Dudley et al.
5,597,354 A 1/1997 Janu et al.
5,629,481 A 5/1997 Sultan
5,769,315 A * 6/1998 Drees ..... 236/49.3
5,791,408 A * 8/1998 Seem ..... 165/250
5,971,067 A 10/1999 Rayburn et al.
6,047,557 A 4/2000 Pham et al.
6,082,128 A 7/2000 Lake et al.
(Continued)

OTHER PUBLICATIONS

European Search Report received in European Patent Application No. 14189431.1, dated Mar. 19, 2015, 5 pages.

*Primary Examiner* — Steven B McAllister
*Assistant Examiner* — Samantha Miller
(74) *Attorney, Agent, or Firm* — Hubbard Johnston, PLLC

(57) ABSTRACT

Systems and methods are disclosed for ventilating a building using a rooftop heating ventilating and air conditioning system that in one instance involve determining a first outdoor airflow into the system through a barometric relief damper; subtracting the first outdoor airflow from a minimum required outdoor airflow rate to arrive at second outdoor airflow; and setting an outdoor damper to provide an outdoor airflow through the outdoor damper that is greater than or substantially equal to the second outdoor airflow. Other systems and methods are disclosed.

10 Claims, 6 Drawing Sheets

(56) References Cited

U.S. PATENT DOCUMENTS

| | | | | |
|---|---|---|---|---|
| 6,126,540 | A * | 10/2000 | Janu et al. | 454/229 |
| 7,600,388 | B2 | 10/2009 | Vestal | |
| 2003/0181158 | A1* | 9/2003 | Schell | F24F 3/0442 454/229 |
| 2004/0244392 | A1 | 12/2004 | Gilch et al. | |
| 2005/0224591 | A1 | 10/2005 | Wolfson | |
| 2006/0116067 | A1* | 6/2006 | Federspiel | 454/256 |
| 2006/0117769 | A1* | 6/2006 | Helt | F24F 11/0001 62/161 |
| 2006/0150644 | A1 | 7/2006 | Wruck | |
| 2006/0174560 | A1 | 8/2006 | Levine et al. | |
| 2007/0190925 | A1* | 8/2007 | Tollar | F24F 7/025 454/242 |
| 2007/0218828 | A1 | 9/2007 | Baik | |
| 2007/0261422 | A1 | 11/2007 | Crawford | |
| 2008/0160901 | A1* | 7/2008 | Stanimirovic | 454/239 |
| 2008/0161976 | A1* | 7/2008 | Stanimirovic | 700/276 |
| 2009/0005912 | A1 | 1/2009 | Srivastava et al. | |
| 2009/0205354 | A1 | 8/2009 | Brown | |
| 2009/0223233 | A1 | 9/2009 | Taras et al. | |
| 2009/0236432 | A1* | 9/2009 | Malloy | F24F 3/044 236/49.3 |
| 2010/0199672 | A1* | 8/2010 | Bellows | F01K 9/006 60/660 |
| 2011/0046790 | A1* | 2/2011 | Miller | G05B 19/042 700/276 |
| 2011/0146651 | A1 | 6/2011 | Puranen et al. | |
| 2012/0052791 | A1* | 3/2012 | Kurelowech | F24F 11/0017 454/329 |
| 2013/0161403 | A1 | 6/2013 | Douglas et al. | |
| 2014/0242902 | A1* | 8/2014 | Ali | F24F 13/14 454/359 |

* cited by examiner

SYSTEMS AND METHODS FOR VENTILATING A BUILDING

FIELD

This application is directed, in general, to heating, ventilating and air conditioning or cooling (HVAC) systems, and more specifically, to methods and systems involving determining and employing a ventilation airflow rate in HVAC systems.

BACKGROUND

Heating, ventilating, and air conditioning (HVAC) systems can be used to regulate the environment within an enclosed space. Typically, an air blower is used to pull air (i.e., return air) from the enclosed space into the HVAC system through ducts and push the air into the enclosed space through additional ducts after conditioning the air (e.g., heating, cooling or dehumidifying the air). Unless otherwise indicated, as used throughout this document, "or" does not require mutual exclusivity. Various types of HVAC systems may be used to provide conditioned air for enclosed spaces.

For example, some HVAC units are located on the rooftop of a commercial building. These so-called rooftop units, or RTUs, typically include one or more blowers and heat exchangers to heat or cool the building, and baffles to control the flow of air within the RTU. Some RTUs also include an air-side economizer that allows selectively providing fresh outside air (i.e., ventilation or ventilating air) to the RTU or to recirculate exhaust air from the building back through the RTU to be cooled or heated again.

At least one type of an economizer includes two damper assemblies driven by a common actuator. The damper blades are linked such that when the outdoor damper is open, the return air damper is closed. When a building is occupied, the outdoor damper of the economizer is typically opened a small amount (e.g., ten to twenty five percent) to allow fresh air into the building to meet ventilation requirements. When the outdoor air is colder than the return air and cooling is needed, the outdoor damper is typically opened to a hundred percent to allow the cooler outdoor air to enter the building. These two functions of an economizer are often referred to as a ventilation mode and a free cooling mode, respectively.

BRIEF DESCRIPTION

Illustrative embodiments of the present invention are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

Figure 1:
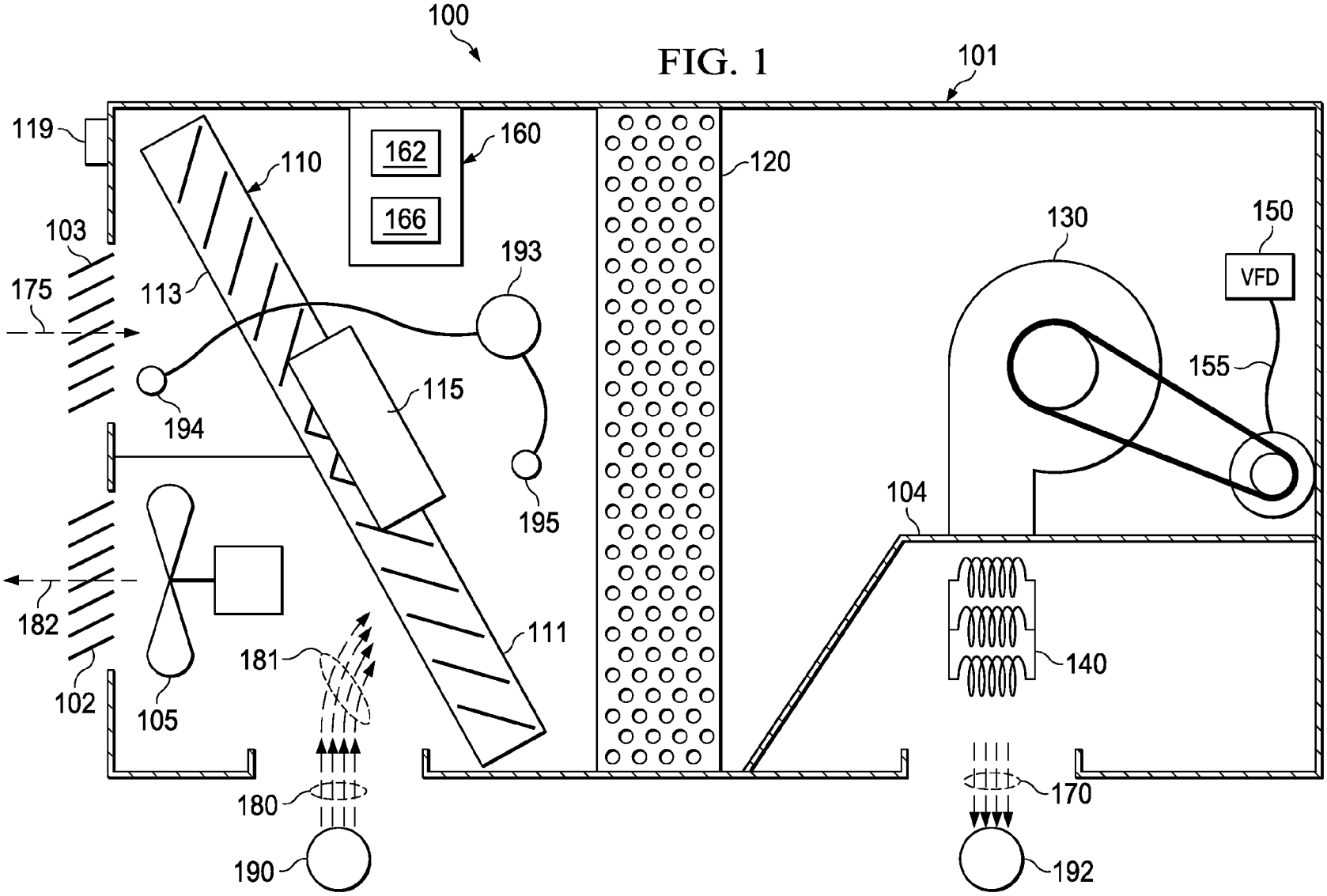
FIG. 1 illustrates a block diagram of an illustrative embodiment of an HVAC system constructed according to at least some of the principles of the disclosure.

FIG. 1 illustrates a schematic diagram of an illustrative embodiment of an heating, ventilating, and air conditioning or cooling (HVAC) system 100 that includes an enclosure 101 (e.g., a cabinet) with openings for exhaust air, ventilation air, return air and supply air. The enclosure 101 includes exhaust vents 102 and ventilation vents 103 at the corresponding exhaust air and ventilation air openings. Within the enclosure 101, the system 100 includes an exhaust fan 105, economizer 110, a cooling element 120, an indoor fan or blower 130 and a heating element 140. Additionally, the system 100 includes a fan controller 150 and a HVAC controller 160. The fan controller 150 is coupled to the blower 130 via a cable 155. The cable 155 is a cable used with HVAC systems. It should be apparent that other coupling devices or techniques may be used, e.g., wireless. The HVAC controller 160 can be connected (not illustrated) to various components of the system 100, including a thermostat 119 for determining outside air temperature, via wireless or hardwired connections for communicating data. Cabling or wireless communications systems may be employed. Also included within the enclosure 101 is a partition 104 that supports the blower 130 and provides a separate heating section.

The system 100 is a rooftop unit (RTU). One skilled in the art will understand that the system 100 can include other partitions or components that are typically included within an HVAC system such as an RTU. While the illustrative embodiment of the system 100 is discussed in the context of a RTU, the scope of the disclosure includes other HVAC applications that are not roof-top mounted.

The blower 130 operates to force an air stream 170 into a structure, such as a building, being conditioned via an unreferenced supply duct. A return airstream 180 from the building enters the system 100 at an unreferenced return duct.

A first portion 181 of the air stream 180 re-circulates through the economizer 110 and joins the air stream 170 to provide supply air to the building. A second portion of the air stream 180 is air stream 182 that is removed from the system 100 via the exhaust fan 105.

The economizer 110 operates to vent a portion of the return air 180 and replace the vented portion with the air stream 175. Thus air quality characteristics such as $CO_2$ concentration and humidity may be maintained within defined limits within the building being conditioned. The economizer 110 includes an indoor damper 111, an outdoor damper 113 and an actuator 115 that drives (opens and closes) the indoor and outdoor dampers 111, 113 (i.e., the blades of the indoor and outdoor dampers 111, 113). Though the economizer 110 includes two damper assemblies, one skilled in the art will understand that the concepts of the disclosure also apply to those economizers or devices having just a single damper assembly, an outdoor damper assembly. As used herein, "damper assembly" may men one or two or more dampers.

The controller 160 includes an interface 162 and a ventilation director 166. The ventilation director 166 may be implemented on a processor or a memory of the controller 160. The interface 162 receives feedback data from sensors and components of the system 100 and transmits control signals thereto. As such, the controller 160 may receive feedback data from, for example, the exhaust fan 105, the blower 130 or the fan controller 150, the economizer 110 and the thermostat 119, and transmit control signals thereto if applicable. One skilled in the art will understand that the location of the controller 160 can vary with respect to the HVAC system 100.

The interface 162 may be an interface that employs a known protocol for communicating (i.e., transmitting and receiving) data. The interface 162 may be configured to receive both analog and digital data. The data may be received over wired, wireless or both types of communication mediums. In some illustrative embodiments, a communications bus may be employed to couple at least some of the various operating units to the interface 162. Though not illustrated, the interface 162 includes input terminals for receiving feedback data.

The feedback data received by the interface 162 includes data that corresponds to a pressure drop across the outdoor damper 113 and damper position of the economizer 110. In some illustrative embodiments, the feedback data also includes the supply airflow rate. Various sensors of the system 100 are used to provide this feedback data to the HVAC controller 160 via the interface 162. In some illustrative embodiments, a return pressure sensor 190 is positioned in the return air opening to provide a return static pressure. The return pressure sensor 190 measures the static pressure difference between the return duct and air outside of the HVAC system 100. In one illustrative embodiment, a supply pressure sensor 192 is also provided in the supply air opening to indicate a supply pressure to the HVAC controller 160. The supply pressure sensor 192 measures the static pressure difference between the return duct and the supply duct. Pressure sensor 193 is used to provide the pressure drop across outdoor damper 113 of the economizer 110. The pressure sensor 193 is a pressure transducer that determines the static pressure difference across the outdoor damper 113. The pressure sensor 193 includes a first input 194 and a second input 195 for receiving the pressure on each side of the outdoor damper 113. The pressure sensors discussed herein can be the type of pressure sensors typically used in HVAC systems.

The HVAC controller 160 is configured to determine supply airflow according to various techniques. For example, in one illustrative embodiment, the HVAC controller 160 is configured to calculate the supply airflow rate based on a set of blower curves, fan power and fan speed.

Economizer damper position is provided to the HVAC controller 160 via the actuator 115. The actuator 115 is configured to rotate or move the indoor and outdoor dampers 111, 113, of the economizer 110 in response to a received signal, such as control signals from the HVAC controller 160 (i.e., the ventilation director 166). The actuator 115 may be an electrical-mechanical device that provides a signal that corresponds to the economizer damper position (i.e., blade angle of the outdoor damper 113 of the economizer 110). The signal is an electrical signal that is received by the ventilation director 166 which is configured to determine the relative angle of the outdoor damper 113 based on the signal from the actuator 115. A lookup table or chart may be used by the processor 117 to determine a relative blade angle with respect to an electrical signal received from the actuator 115. The angle can be based on (i.e., relative to) the ventilation opening of the HVAC system 100. In some illustrative embodiments, the economizer damper position can be determined via other means. For example, an accelerometer coupled to a blade (or multiple accelerometers to multiple blades) of the outdoor damper 113 may be used to determine the economizer damper position. The outdoor damper 113 is opened at 100 percent when the blades thereof are positioned to provide maximum airflow of ventilation air 175 into the system 100 through the ventilation opening. In FIG. 1, the blades of the outdoor damper 113 would be perpendicular to the ventilation opening or the frame surrounding the ventilation opening when opened at 100 percent. In the illustrated embodiment, the blades of the outdoor damper 113 would be parallel to the ventilation opening when opened at zero percent.

Figure 3:
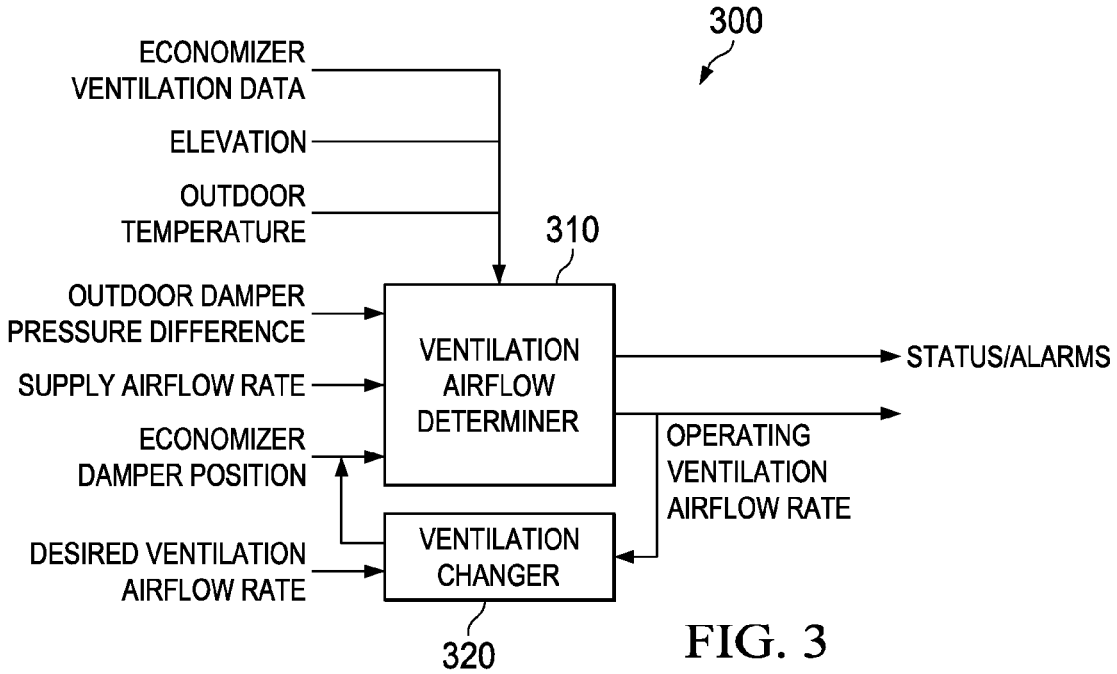
FIG. 3 illustrates a block diagram of an illustrative embodiment of ventilation director constructed according to at least some of the principles of the disclosure.

The ventilation director 166 is configured to determine an operating ventilation airflow rate of the HVAC system 100 through the ventilation vents 103 based on the static pressure difference across the outdoor dampers 113, the economizer damper position and economizer ventilation data. In embodiments presented further below, the air entering through the exhaust vents (or barometric relief damper) will be considered as well. In some illustrative embodiments, the ventilation director 166 also employs the supply airflow rate to calculate the operating ventilation airflow rate. In one illustrative embodiment, using the supply airflow rate for the calculation is based on the economizer damper position being above 50 percent. In one illustrative embodiment, the economizer ventilation data is developed during manufacturing or engineering of the system 100 or similar type of HVAC systems. During development, a ventilation airflow rate is measured in, for example, a laboratory, at a variety of operating conditions. Various sensors or other type of measuring devices are employed during the development to obtain the measured data for the various operating conditions to develop a known relationship that can be used. Economizer ventilation data is developed from the measured data and loaded into the HVAC controller 160, such as a memory thereof. During operation in the field, the HVAC controller 160 (e.g., the ventilation director 166) receives the feedback data and calculates the ventilation airflow rate employing the feedback data and the economizer ventilation data. FIG. 3 provides a more detailed illustrative embodiment of a ventilation director 166.

The ventilation director 166 is further configured to adjust a position of the economizer 110 based on the economizer damper position and a desired ventilation airflow rate. The desired ventilation airflow rate can be preprogrammed into a memory of the HVAC controller 160 during manufacturing. The ventilation flow rate may be required by applicable standards or may be a desired outdoor airflow rate. In some illustrative embodiments, the desired ventilation airflow rate is entered into the HVAC controller 160 in the field during, for example, installation, a maintenance visit or a service visit. The ventilation director 166 generates a signal that directs the actuator 115 to adjust a position of the blades of the economizer 110 based on the desired ventilation airflow rate through the ventilation vents 103. In some illustrative embodiments, this signal represents a difference between the operating ventilation airflow rate and the desired ventilation airflow rate.

Figure 2:
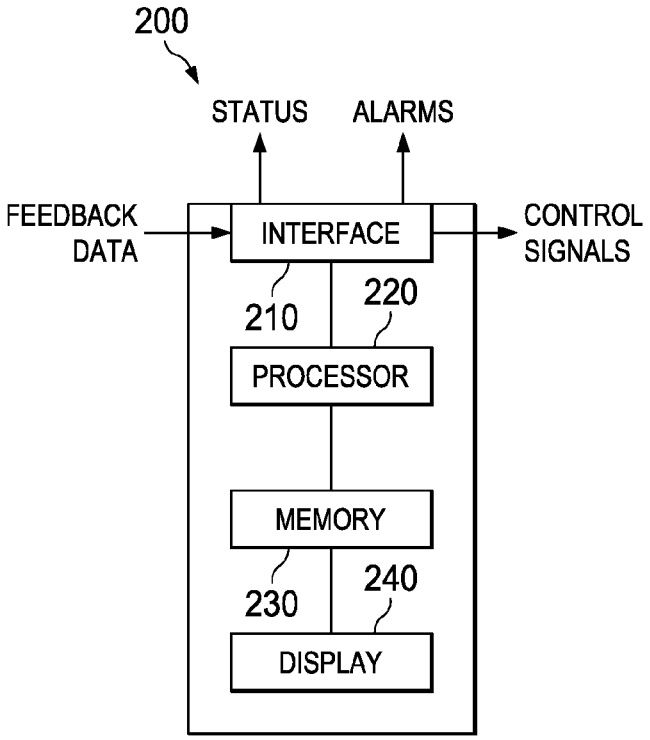
FIG. 2 illustrates a block diagram of an illustrative embodiment of a controller constructed according to at least some of the principles of the disclosure.

FIG. 2 illustrates a block diagram of an illustrative embodiment of a controller 200 that is configured to direct the operation of or at least part of the operation of an HVAC system, such as HVAC system 100. As such, the controller 200 is configured to generate control signals that are transmitted to the various components to direct the operation thereof. The controller 200 may generate the control signals in response to feedback data that is received from the various sensors or components of the HVAC system. The controller 200 includes an interface 210 that is configured to receive and transmit the feedback data and control signals. The interface 210 may be a typical interface that is used to communicate (i.e., receive and transmit) data for a controller, such as a microcontroller.

The interface 210 may include a designated input terminal or input terminals that are configured to receive feedback data from a particular component. The controller 200 also includes a processor 220 and a memory 230. The memory 230 may be the type of memory typically located within a controller, such as a microcontroller, that is constructed to store data and computer programs. The memory 230 may store operating instructions to direct the operation of the processor 220 when initiated thereby. The operating instructions may correspond to algorithms that provide the functionality of the operating schemes disclosed herein. For example, the operating instructions may correspond to the algorithm or algorithms that implement the method illustrated in FIG. 5. The processor 220 may be a microprocessor or other processor. The controller 200 also includes a display 240 for visually providing information to a user. The interface 210, processor 220 memory 230, and display 240 may be coupled together via various means to communicate information. The controller 200 may also include additional components typically included within a controller for a HVAC unit, such as a power supply or power port.

The controller 200 is configured to receive feedback data from the HVAC system including feedback data that corresponds to, for example, a pressure difference across an outdoor damper of an economizer, supply airflow rate and economizer damper position of the HVAC system. Additionally, the controller 200 is configured to determine an operating ventilation airflow rate of the HVAC system based on operating data, such as, the outdoor damper pressure difference, the supply airflow rate and the economizer damper position during operation. In some illustrative embodiments, the controller 200 also receives and employs condition data, such as, the outside ambient temperature and the elevation at the HVAC system, when calculating the ventilation airflow rate. The controller 200 calculates the ventilation airflow rate employing the feedback data, that includes the operating and condition data of the HVAC system, with the appropriate corresponding economizer data. In one illustrative embodiment, the economizer data is predetermined economizer ventilation data that is specific for particular HVAC systems or types of HVAC systems.

The controller 200 is further configured to adjust a position of an economizer of the HVAC system based on the economizer damper position and a desired ventilation airflow rate. In other embodiments, the controller 200 may also consider airflow into the system from the barometric relief damper. In one illustrative embodiment, the controller 200 generates and transmits control signals to an actuator of the economizer to adjust the economizer damper position. In addition to the operation schemes disclosed herein, the controller 200 can be configured to provide control functionality beyond the scope of the present disclosure.

The controller 200 may be configured to generate alarms and status based on the ventilation airflow rate. In some illustrative embodiments, the controller 200 is configured to employ the ventilation airflow rate to determine a prorated ventilation airflow rate and direct the operation of an HVAC system based thereon.

Referring now primarily to FIG. 3, an illustrative embodiment of ventilation director 300 is presented. The ventilation director 300 may be embodied as a series of operation instructions that direct the operation of a processor when initiated thereby. In one illustrative embodiment, the ventilation director 300 is implemented in at least a portion of a memory of an HVAC controller, such as a non-transitory computer readable medium of the HVAC controller. The ventilation director 300 includes a ventilation airflow determiner 310 and a ventilation changer 320.

The ventilation airflow determiner 310 is configured to calculate the operating ventilation airflow rate based on feedback data and economizer ventilation data. The economizer ventilation data is measured data that was obtained under various operating conditions in a laboratory environment. In one illustrative embodiment, the economizer ventilation data is specific for a particular type of HVAC system.

The ventilation airflow determiner 310 receives feedback data, such as operating data and condition data, from the HVAC system. The feedback data includes the outdoor damper pressure difference, the supply airflow rate and the economizer damper position—and may also include outdoor air entering through the barometric relief damper. In one illustrative embodiment, the outdoor damper pressure difference is received from a pressure transducer, such as pressure sensor 193, that determines the pressure difference. In some illustrative embodiments the return duct pressure drop is employed for the outdoor damper pressure difference. The return duct pressure drop may be determined via a number of means and provided to the ventilation airflow determiner 310 for the outdoor damper pressure difference.

In typical applications, the return static pressure is within a range of a tenth of an inch to a half of an inch (0.1 inch to 0.5 inch) of water column. In some illustrative embodiments, the ventilation airflow rate ranges from 10 percent to 30 percent of the design airflow rate for the HVAC system. This 30 percent ventilation airflow rate of the designed system airflow rate can usually be obtained with a damper opening of 35 percent.

The elevation of the HVAC system can be stored in a memory of an HVAC controller. In one illustrative embodiment, the elevation is stored in the ventilation airflow determiner 310. The elevation is a parameter that is typically entered by a user during initial setup. The elevation may be entered, for example, during installation or a service visit. The outdoor temperature can be provided by a thermometer associated with the HVAC system. As discussed with respect to FIG. 1, the supply airflow rate can be provided by various means and the economizer damper position can be provided from feedback data of an economizer actuator.

The ventilation airflow determiner 310 is configured to calculate the ventilation airflow rate employing a combination of equations, feedback data and the economizer ventilation data. In some illustrative embodiments, the economizer ventilation data is stored in look-up tables.

The ventilation airflow determiner 310 calculates the ventilation airflow rate differently according to the current economizer damper position. When the current economizer damper position is 50 percent or less, the ventilation airflow determiner 310 employs Equation 1 to calculate the ventilation airflow rate.

$$\text{Ventilation Airflow Rate}=1096*CA(\Delta P/\rho)1/2 \quad \text{(Equation 1)}$$

In Equation 1, ΔP is the outdoor damper pressure difference and CA is the damper effective open area expressed in squared feet (i.e., ft2). The value 1096 is a conversion constant that is used to make the measurement units more useable. The effective open area CA is calculated employing a flow coefficient table of the economizer ventilation data established for the HVAC system. Flow coefficient data is a parameter developed from testing of HVAC systems that is a function of damper position and relates outdoor damper position to the effective open area CA. The ventilation airflow determiner 310 is configured to select the appropriate flow coefficient data from the economizer ventilation data based on the economizer damper position. For a current economizer damper position that is 50 percent or less, a first table of flow coefficient data is selected and employed. Table 1 is an example of a flow coefficient table that is selected for an economizer damper position less than or equal to 50 percent. The values in Table 1 are unique for a particular economizer damper assembly and are provided as an example. The flow coefficients for two HVAC models, Model A and Model B, are provided in Table 1. One skilled in the art will understand that flow coefficient tables for other particular HVAC systems can be developed and stored with a controller of the particular HVAC systems. In some illustrative embodiments, the ventilation airflow determiner 310 is configured to determine the effective air opening CA by interpolation of the data in a flow coefficient table such as Table 1.

TABLE 1

Flow Coefficients for Economizer Damper Position Equal To or Less Than Fifty Percent

| % OPEN | CA MODEL A | CA MODEL B |
|---|---|---|
| 0 | 0.0 | 0.0 |
| 5 | 0.055736 | 0.04812 |
| 10 | 0.083934 | 0.095381 |
| 15 | 0.113264 | 0.125026 |
| 20 | 0.151411 | 0.166996 |
| 25 | 0.208313 | 0.219794 |
| 30 | 0.278474 | 0.289318 |
| 35 | 0.354823 | 0.390838 |
| 40 | 0.460648 | 0.538106 |
| 45 | 0.588303 | 0.718347 |
| 50 | 0.722145 | 0.942691 |

In Table 1, "% Open" represents the outdoor damper blade position relative to the frame of the HVAC system at the ventilation opening. In one illustrative embodiment, the % Open is calculated using an actuator feedback signal. The relationship between the % Open and the actuator feedback signal is typically dependent on the characteristics of the actuator and the design of the economizer. In one illustrative embodiment, the relationship between % Open and the actuator feedback signal is represented with Equation 2.

$$\%\ \text{Open}=100\times(V_{feedback}-V_{offset})/8 \quad \text{(Equation 2)}$$

$V_{feedback}$ and $V_{offset}$ correspond to the type of actuator that is used. $V_{feedback}$ is the feedback voltage output by the actuator. $V_{offset}$ is a voltage value that corresponds to a fully closed economizer. In one illustrative embodiment, $V_{offset}$ is nominally two volts, $V_{feedback}$ is two volts when the damper is 0% open and $V_{feedback}$ is ten volts when 100% open. The number 8 in Equation 2 is a conversion constant that is specific to the type of actuator employed.

$V_{offset}$ may vary from part to part. For example, in one illustrative embodiment $V_{offset}$ can vary between 2.1 volts to 2.75 volts with a closed damper. As such, instead of using a fixed offset based on the actuator specification, in some illustrative embodiments a measured offset is used. To determine the measured offset, the actuator is commanded to go to its minimum position during calibration. After waiting the amount of time required to move to its minimum position, the ventilation airflow determiner 310 measures the feedback voltage. If the feedback voltage is within the normal variation of offset voltage, the current feedback is recorded as the offset voltage. If the feedback voltage is not within the normal variation of offset voltage, an error code is generated and the default offset is used.

Figure 4:
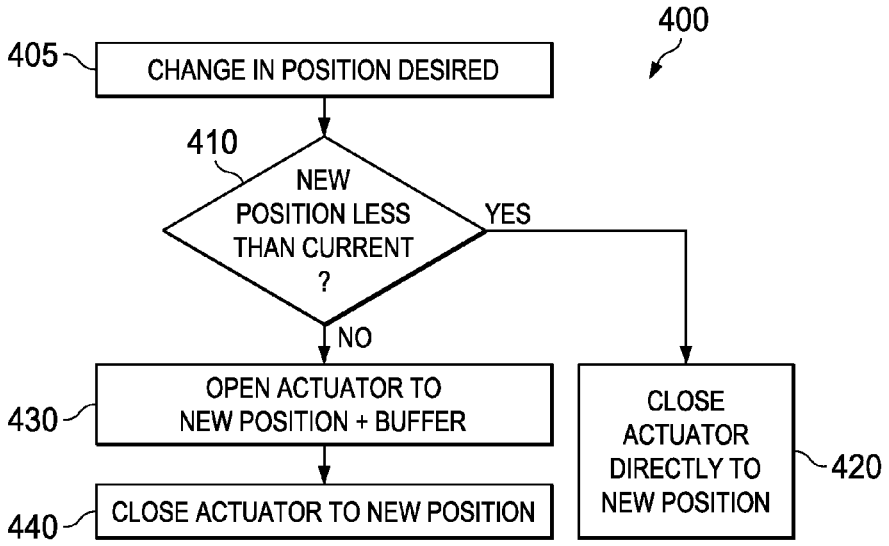
FIG. 4 illustrates a flow diagram of an illustrative embodiment of a method of repositioning the dampers of an economizer according to at least some of the principles of the disclosure.

During operation, hysteresis in the relationship between the actuator feedback signal and the actual position of the economizer damper blades can occur. As such, the ventilation director 300 (i.e., the ventilation airflow determiner 310 or the ventilation changer 320) can reposition the damper blades. The flow diagram of FIG. 4 presents an illustrative embodiment of such a method.

Returning to Equation 1, p is the density of air entering the outdoor damper. In one illustrative embodiment, the ventilation airflow determiner 310 calculates the air density p employing Equation 3.

$$P=0.075((460+64)/(460+T_{OD}))(P_{atm}/14.696) \quad \text{(Equation 3)}$$

In Equation 3, $T_{OD}$ is the outdoor temperature in Fahrenheit and $P_{atm}$ is the atmospheric pressure calculated by Equation 4.

$$P_{atm}=14.696*(1-6.876E-6*ALT)^{5.25588} \quad \text{(Equation 4)}$$

In Equation 3, ideal gas relationships are being used to correct air density for temperature and pressure variations. 0.075 is a reference density of air at 64 F and 14.696 psia (sea level). The first term 460+64/46+T corrects the reference density for temperature (460 is used to convert the temperature to the absolute ranking scale). The term $P_{atm}$/14.696 corrects for atmospheric pressure. Thus, the density is calculated using $T_{OD}$ and $P_{atm}$ and ideal gas relationships. Equation 4 is a standard equation used by the national weather service to calculate atmospheric pressure as a function of elevation wherein the terms have been converted for US units.

In Equation 4, ALT is the elevation of the HVAC system in feet and is a user entered parameter. An elevation of 650 feet, which is approximately the median elevation, is entered as a default elevation. This can be entered during manufacturing of an HVAC system or when programming a controller of the HVAC system. Additionally, a default outdoor temperature of 70 degrees Fahrenheit may also be used. Calculating the air density based on elevation and temperature increase the accuracy of the ventilation measurement across wide temperatures and at high altitudes.

When the current economizer damper position is greater than 50 percent, the ventilation airflow determiner 310 employs a different flow coefficient table to calculate the ventilation airflow rate. For example, Table 2 represents a flow coefficient table for a particular type of HVAC system when the current economizer damper position is greater than 50 percent. In some illustrative embodiments, the ventilation airflow determiner 310 is configured to determine the percentage of outdoor air by interpolation of the data in a flow coefficient table such as Table 2. Once the percentage of outdoor air is known, the ventilation airflow determiner 310 multiplies the percentage of outdoor air by the total supply airflow to determine the ventilation airflow rate. As with Table 1, the flow coefficients for two different models of HVAC systems are provided as an example.

TABLE 2

Flow Coefficients for Economizer Damper Positions Greater Than Fifty Percent

| % OPEN | % OD AIR MODEL A | % OD AIR MODEL B |
|---|---|---|
| 50 | 65.3 | 65.3 |
| 60 | 79 | 79 |
| 70 | 88.2 | 88.2 |
| 80 | 95.1 | 95.1 |
| 90 | 97 | 97 |
| 100 | 97 | 97 |

Thus, the ventilation airflow determiner 310 selects the appropriate flow coefficient table to employ based on the current economizer damper position and determines the operating ventilation airflow rate that is provided to the ventilation changer 320. The ventilation changer 320 receives the operating ventilation airflow rate and a desired ventilation airflow rate. Based on these received airflow rates, the ventilation changer 320 adjusts the economizer damper position to obtain the desired ventilation airflow rate. The desired ventilation airflow rate may be received via a user interface, such as a touch screen or keypad or Internet, associated with an HVAC controller or the ventilation director 300. In one illustrative embodiment, the desired ventilation airflow rate is stored and received from a memory, such as the memory of an HVAC controller. The various ventilation airflow rates may be provided to a user via a display of an HVAC controller.

The ventilation changer 320, therefore, uses the ventilation airflow rate determined above to automatically adjust the damper actuator position command delivered to the actuator to achieve a user specified ventilation rate. In some illustrative embodiments, the ventilation changer 320 is configured to minimize movement of the actuator. As such, concerns about reliability limitations of an economizer actuator are minimized. Accordingly, in some illustrative embodiments, a ventilation changer 320 is configured to change the damper position once per a designated time. In some illustrative embodiments, the ventilation changer 320 is configured to change the damper position only once in every 10 minutes. In other illustrative embodiments, the ventilation changer 320 is configured to change the damper position when the operating state of the fan system has changed. The basis for determining when to change the damper position and the designated time for changing the damper position are adjustable.

In some illustrative embodiments, designated events may be predetermined to use as a basis for determining when to change the damper position. For example, a change in supply air fan speed and a change in ventilation set point can be used to trigger a change in damper position. In one illustrative embodiment, the ventilation changer 320 is configured to continuously integrate the error between the actual ventilation rate and the desired rate when waiting to make a control move. In one illustrative embodiment, the ventilation changer 320, when determining it is time to make a control move, determines the next position of the damper blades of the outdoor damper with following procedure:

(1) Calculate an integral offset of the actuator where the integral offset=−1*Integrated Error/Integral Gain. If the absolute value of the integral offset is greater than the desired ventilation rate, then the integral offset is set equal to the integral offset multiplied by the desired ventilation rate divided by the absolute value of the integral offset. To prevent over opening or over closing the damper, a ventilation rate more than some limit, e.g., twice the normal ventilation rate may not be employed.

(2) Calculate the new ventilation target airflow using the following by adding the desired ventilation rate and the integral offset together.

(3) Calculate the current ventilation airflow rate using a procedure defined above with respect to the ventilation airflow determiner 310.

(4) Acquire the current outdoor damper pressure difference.

(5) Acquire the current supply airflow.

(6) Acquire the current economizer damper position.

(7) Calculate the new predicted damper pressure difference employing the following equation, Equation 5, wherein CurrentDP is the current economizer damper position, CurrentCFM is the current supply airflow and VentTarget is the ventilation target. For Equation 5, the ventilation changer 320 can employ the return duct static pressure difference as the pressure difference across the outdoor damper. Typically, the return duct pressure drop is proportional to the square of the airflow rate through the return duct. In this illustrative embodiment, the ventilation changer 320 assumes that the airflow through the return duct is equal to the supply airflow rate minus the ventilation airflow rate.

$$\text{new}DP=\text{Current}DP*((\text{Current}CFM-\text{VentTarget})/(\text{Current}CFM-\text{CurrentVent}))^2 \quad \text{(Equation 5)}$$

(8) Calculate the new CA employing Equation 6.

$$\text{new}CA=\text{VentTarget}/(\text{new}DP)^{0.5} \quad \text{(Equation 6)}$$

(9) Use the economizer ventilation data (such as Table 1) to determine the economizer damper position, i.e., the new damper position associated with the new CA, and determine the position difference between the new damper position and the current damper position. If the absolute value of the position difference is less than Deadband (i.e., less than the steps at which the actuator can move, such as 1.5% step), then set the new damper position as the new damper position. Otherwise, set the new damper position equal to the current position.

The ventilation director 300 (i.e, either the ventilation airflow determiner 310 or the ventilation changer 320 or a combination thereof) can also perform diagnostics, detect faults with the economizer and generate alarms. The alarms could be visually presented on a display of a controller or communicated to a monitor or monitoring service. An audible alarm may also be generated. The diagnostics can be used to warn a user of a fault which could cause an inaccurate measurement of ventilation airflow. An example of an alarm resulting from receiving feedback data from the economizer actuator includes Damper Stuck. Damper Stuck can be determined by comparing actuator feedback position to command position. During operation of the damper actuator, the feedback position of the damper is compared with the desired position. Once the actuator has stopped moving, if the feedback position in not within a prescribed tolerance of the desire position, the algorithm indicates a fault. The ventilation director 300, will continue to monitor the feedback position and automatically clear the fault should the feedback start to match the command.

In one illustrative embodiment, the ventilation director 300 is also configured to perform damper pressure sensor diagnostics. Based on normal operating data that can be stored in an HVAC controller, the ventilation director 300 can compare the outdoor damper pressure difference with the percent of damper opening and generate an alarm if the measured pressure is out of range compared to the stored operating data. An error can be recorded and an alarm generated based on the comparison.

The ventilation director 300 can also be configured to employ the ventilation airflow rate to determine the damper position necessary to deliver required ventilation only when the compressor is running. As such, humidity problems associated with a continuous fan can be reduced or eliminated and operation of the HVAC system can still comply with Indoor Air Quality standards established by governing bodies, such as the ASHRAE 62.1 standard. In one illustrative embodiment, the ventilation director 300 is configured to determine a prorated ventilation airflow rate and deliver the required ventilation as described below. An hour is used in the illustrative embodiment discussed below but other amounts of time may also be used in different embodiments.

(1) At the beginning of each hour: a. determine the fraction of compressor on time during the past hour (i.e., runfrac); b. calculate the required ventilation rate (when compressor is on using Equation 7 employing runfrac and the ventilation rate when the compressor is on continually ($Qvent_{CONT}$). The constant 1.2 in Equation 7 is a margin of safety which ensures the correct amount of ventilation is delivered even if the compressor runs 20% less than the previous hour.

$$Qvent_{CompOn}=1.2(Qvent_{CONT}/runfrac) \quad \text{(Equation 7)}$$

(2) When the compressor is on, set the ventilation controller setpoint to Qvent comp ON.

(3) When the compressor is off, set the ventilation setpoint to 0.

(4) Integrate the amount of ventilation airflow delivered over an hour. If the integrated amount exceeds Qvent cont*60 then set the ventilation setpoint=0.

Referring now primarily to FIG. 4, illustrated is a flow diagram of an illustrative embodiment of a method 400 of repositioning the dampers of an economizer. In some illustrative embodiments, hysteresis results in the relationship between the actuator feedback signal and the actual position of the economizer damper blades. In some illustrative embodiments, the hysteresis can be significant enough to cause a ten percent error in the relationship between the actuator feedback and the damper blade position. The method 400 can be employed to correct this problem. In one illustrative embodiment, a ventilation airflow determiner is configured to perform the method 400. The method 400 represents an algorithm that can be implemented as a series of operating instructions.

The method 400 begins in a step 405 with a change in the position of the dampers being desired. In a decisional step 410, a determination is made if the new desired damper position is less than the current damper position. Thus, step 410 includes comparing the current damper position (e.g., the current percentage of opening) to the desired damper position (e.g., the desired percentage of opening). If the desired position is less than the current position, then the method continues to step 420 where the actuator is closed directly to the desired position. If the desired position is not less than (i.e., greater than) the current position, then the method continues to step 430 where the actuator is opened to the desired position plus an actuator specific buffer. In one illustrative embodiment, the actuator specific buffer is based on the amount of slack of the drive train of the actuator. In some illustrative embodiments, the actuator specific buffer is 1.5 volts. The method 400 then ends in a step 440 where the actuator is closed to the new desired position.

One skilled in the art will understand that the buffer employed can vary based on the type of actuator and the actual installation. The value (e.g., voltage) of the buffer can be determined during calibration. The method 400 represents compensating for hysteresis employing a final close operation (step 440). A similar compensation can be performed by ending in an open operation. For example, in step 430, the actuator could be opened to the new position with the addition of a negative buffer (e.g., −1.5 volts). As such, in step 440, the actuator would be opened to the new position.

Figure 5:
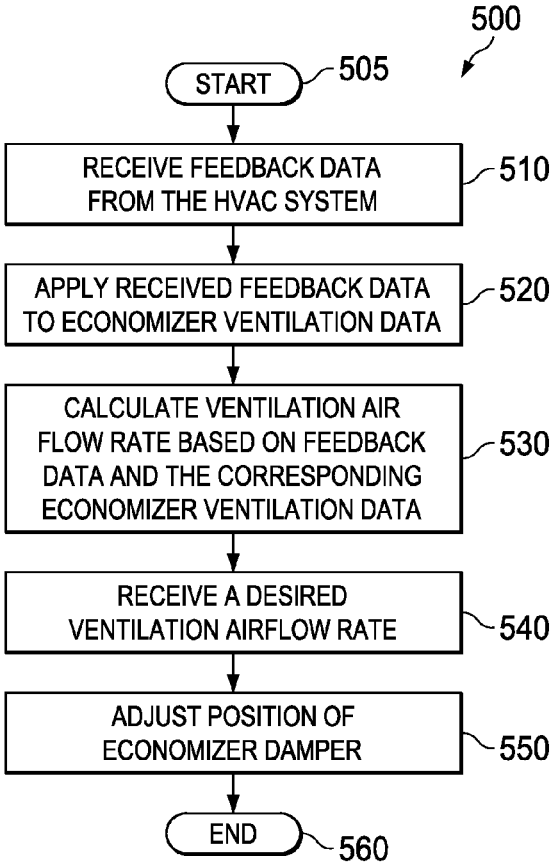
FIG. 5 illustrates a flow diagram of an illustrative embodiment of a method of measuring and managing ventilation airflow of a HVAC system carried out according to at least some of the principles of the disclosure.

FIG. 5 illustrates an illustrative flow diagram of a method 500 of measuring and managing ventilation airflow of a HVAC system. The method 500 may be carried out under the direction of a computer program product. In one illustrative embodiment, a controller of an HVAC system is employed to carry out the method 500. The method 500 begins in a step 505.

In a step 510, feedback data is received from an HVAC system. In one illustrative embodiment, the feedback data corresponds to the pressure difference across an outdoor economizer damper and economizer damper position of the HVAC system. Additionally, the feedback data may include the supply airflow rate. The feedback data is typically real time data obtained during operation of the HVAC system.

The feedback data is applied to economizer ventilation data in a step 520. The feedback data applied may include the outdoor economizer damper pressure difference, the supply airflow rate and the economizer damper position. The economizer ventilation data represents ventilation airflow rates of the HVAC system and is based on measured data obtained before installation of the HVAC system.

In a step 530, an operating ventilation airflow rate is calculated based on the feedback data and the corresponding economizer ventilation data.

A desired ventilation airflow rate is received in a step 540. In a step 550, a position of the economizer is adjusted based on the economizer damper position and the desired ventilation airflow rate. In some illustrative embodiments, the adjustment is zero when the operating ventilation airflow rate is at or within a designated percentage of the desired ventilation airflow rate. In some illustrative embodiments, the desired airflow rate is entered by a user in the field. In other illustrative embodiments, the desired airflow rate is predetermined and established before or during installation.

In these illustrative embodiments, the desired airflow rate can be changed after installation. The method 500 ends in a step 560.

The above-described methods may be embodied in or performed by various digital data processors, microprocessors or computing devices, wherein these devices are programmed or store executable programs of sequences of software instructions to perform one or more of the steps of the methods, e.g., steps of the method of FIG. 5. The software instructions of such programs may be encoded in machine-executable form on digital data storage media that is non-transitory, e.g., magnetic or optical disks, random-access memory (RAM), magnetic hard disks, flash memories, or read-only memory (ROM), to enable various types of digital data processors or computing devices to perform one, multiple or all of the steps of one or more of the above-described methods, e.g., one or more of the steps of the method of FIG. 5. Additionally, an apparatus, such as dedicated HVAC controller, may be designed to include the necessary circuitry to perform each step of the methods disclosed herein.

Figure 6:
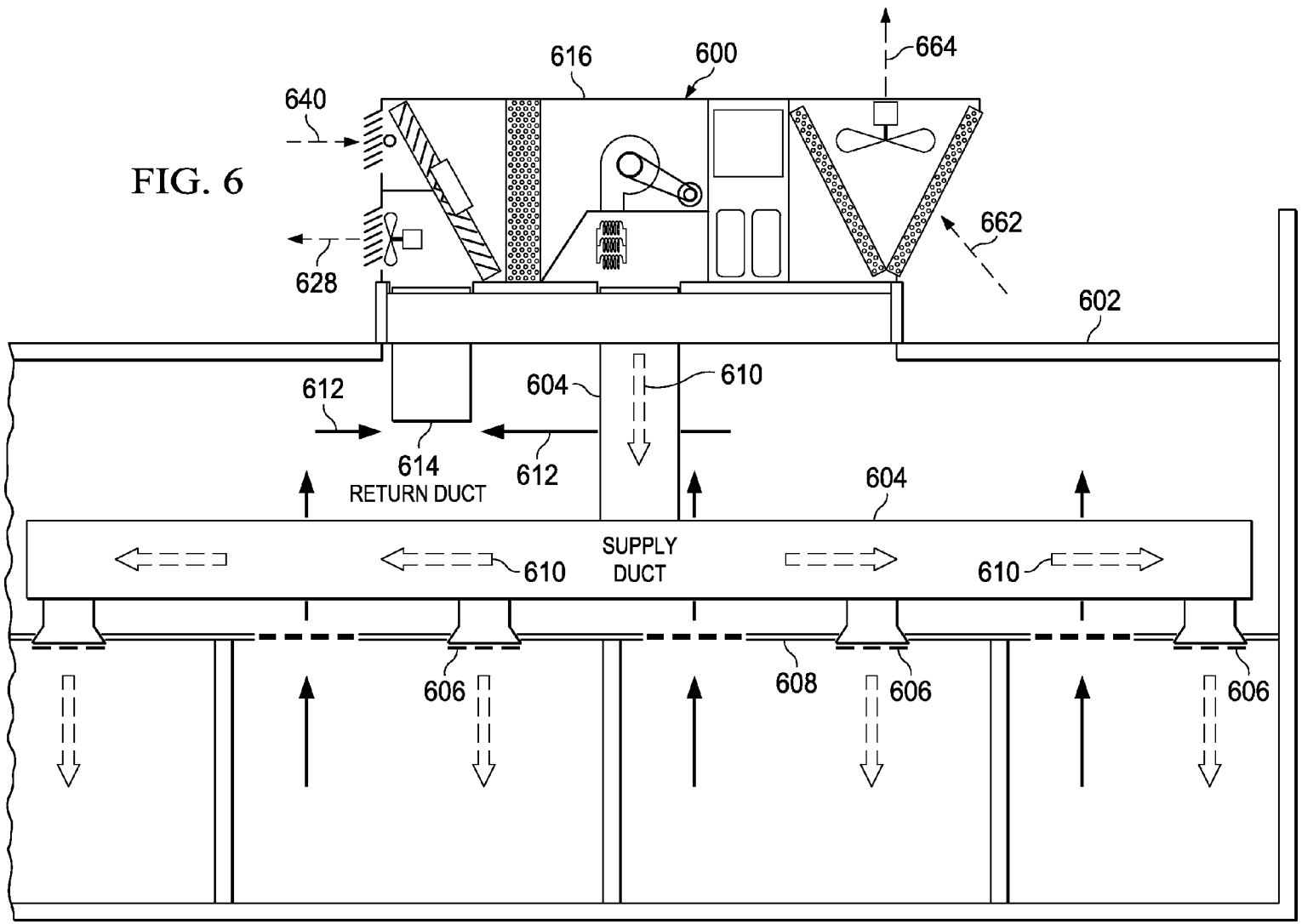
FIG. 6 is a schematic elevational view of an illustrative embodiment of a rooftop heating, ventilation, and air conditioning system according to at least some of the principles of the disclosure.
Figure 7:
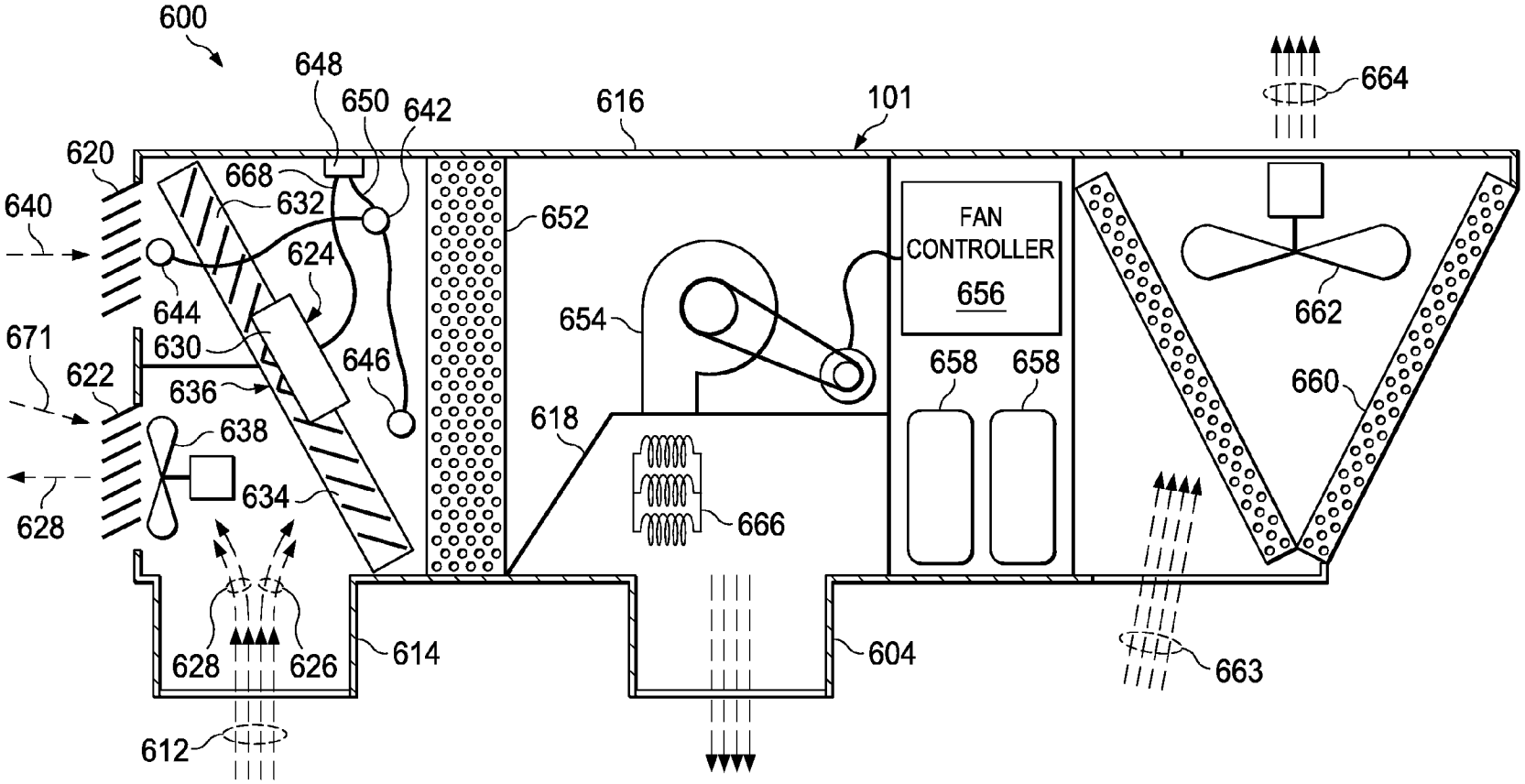
FIG. 7 is a more detailed view of a portion of FIG. 6.

Referring now primarily to FIGS. 6 and 7, another illustrative embodiment of a heating, ventilating, and air conditioning or cooling (HVAC) System 600 is presented. The HVAC System 600 is a rooftop unit (RTU) and is analogous in many respects to the system of FIG. 1. This system 600 accounts for the outdoor airflow through exhaust vents or a barometric relief damper 622 or a gravity exhaust damper. While the illustrative embodiment of system 600 is discussed in the context of an RTU, the scope of the disclosure includes other HVAC applications that are not rooftop mounted. The system 600 is shown on roof 602. The system 600 supplies conditioned air through a supply duct system 604 to room vents 606, which are typically through a ceiling 608. Thus, supply air flow 610 is delivered to an interior of the building. As the air continues to flow, the return air 612 is delivered to a return duct 614 from where it will be conditioned and returned again or will exit the HVAC System 600 or some combination.

The HVAC system 600 includes an enclosure or housing 616, which may include one or more partitions 618 in an interior portion. The enclosure 616 has a ventilation opening that is covered by ventilation vents 620 and an exhaust opening covered by the barometric relief damper 622, or exhaust vents.

The HVAC system 600 includes an economizer 624 that controls ventilation flowing through the ventilation vents 620 and the amount of return air 612 that is recycled as shown by airstream 626 or that is exhausted as shown by exhaust airflow 628. The economizer 624 includes an actuator 630 that is able to move a plurality of blades that make up an outdoor damper 632 and a plurality of blades that make up a return damper or indoor damper 634. The outdoor damper 632 and return damper 634 are part of a damper assembly 636 and may move in a coordinated fashion. An exhaust fan 638 may be used to push the exhaust airflow 628 through the barometric relief damper 622. As noted in connection with FIG. 1, the economizer 624 in economizer mode allows maximum flow of outdoor ventilation airflow 640 into the system 600 and primarily exhausts all of the return airflow 612 as exhaust 628. When in economizer mode, the barometric relief damper 622 provides a low restriction path for the exhaust airflow stream 628 to exit. At other times, the economizer 624 may help to regulate the amount of ventilation introduced to meet indoor air quality standards or satisfy desired levels of fresh air. When not in economizer mode, the barometric relief damper 622 is intended to prevent outdoor airstream/fresh air 671 from entering, but most units leak at some level for a variety of reasons.

One or more pressure sensors 642 are included for measuring pressure at different points. In this example, the pressure sensor 642 measures pressure across the outdoor damper 632. In other illustrative embodiments, additional pressure measurements may be made at various locations, for example, across the return damper 634. The pressure sensor 642 may have transducers 644 and 646 and may be coupled to a controller 648 by a cable 650 or wirelessly or other means. Air leaving the economizer 624 within the system 600 travels in conditioning flow path across a cooler or evaporator 652, and then with the assistance of blower or fan 654 is delivered into the supply duct system 604. A fan controller 656 may be used to control the blower 654 and other components if desired. The fan controller 656 may be separate from or combined with or the same as controller 648.

The HVAC system 600 may include one or more compressors 658 to compress a working fluid used in conjunction with condensers 660 and condenser fans 662 to develop a cold working fluid delivered to the cooler 652 during cooling operations. Outdoor air 663 is pulled across the condenser coils 660 and exhausted at 664 to reject heat. Heating coils 666 are included within the partitioned portion to heat air within a conditioning flow path from the blower 654 during heating operations.

The controller 648 is analogous to the controller 160 in FIG. 1. The controller 648 includes at least one memory and at least one processor associated with at least one memory for carrying out numerous operations and functions. The controller 648 may be coupled to the actuator 630 such as by a cable 668 or other means. As previously noted, the controller 648 may be coupled by the cable 650 to one or more pressure sensors 642. As previously discussed, the correlation of airflow through the economizer 636 based on the position of the outdoor damper 632 and the pressure differential across or proximate the outdoor damper 632 allows for the desired ventilation flow 640 to be set and controlled by the controller 648.

In adjusting the outdoor damper to allow the proper amount of ventilation to enter, typically only air entering the ventilation vents 620 has been considered. Research has shown, however, that depending on the pressure differential proximate the barometric relief damper 622, fresh air 671 is also entering from there. If that air can be properly accounted for, less ventilation air is required through the outdoor damper 632 which allows for enhanced efficiency.

Figure 8:
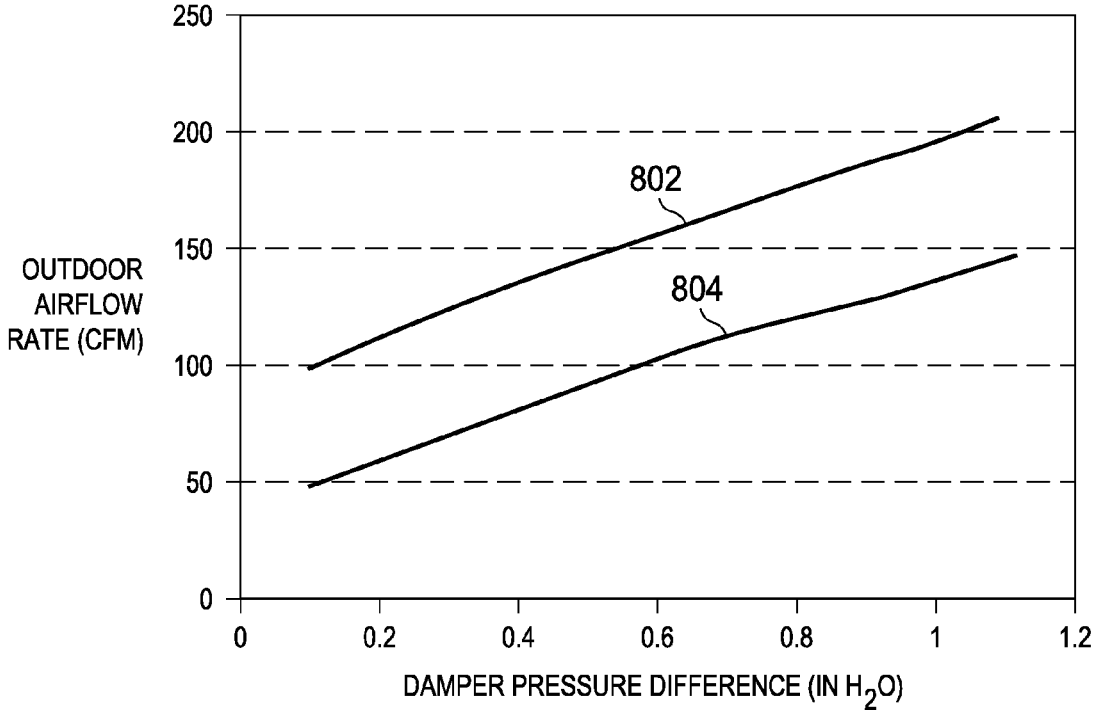
FIG. 8 is a schematic graph for illustration purposes showing qualitatively the air flow through the barometric relief damper as a function of the pressure differential across the exhaust damper.

Referring now to FIG. 8, an illustrative graph is presented showing data that has been obtained for two different rooftop units in an experimentation. This data is for qualitative purposes only. The abscissa has the pressure differential in inches of water across the barometric relief damper 622 and the ordinate shows the amount of outdoor airflow that is introduced through the barometric relief damper 622 under those conditions. The top curve 802 is for a 18.5 inch by 30 inch barometric relief damper applied to a 5 or 6 ton unit and the lower curve 804 is for a 17 inch by 30 inch barometric relief damper applied to a 3 or 4 ton unit. Larger units will use a slightly larger barometric relief damper or multiple relief dampers (collectively referred to herein as a single relief damper). For example, in another illustrative embodiment, the barometric relief damper includes three 18.5 inch by 30 inch assemblies. The curves allow the flow through the barometric relief damper 622 to be estimated with reasonable accuracy using the pressure differential proximate the barometric relief damper. In each instance for an HVAC system being manufactured, such curves can be developed.

The curves may be stored in the controller 648, or a look up table stored, or a function may be derived by fitting data points to a curve. In one illustrative laboratory run, the following data was produced in table form:

TABLE 3

| Outdoor Airflow Through Barometric Relief Damper | |
|---|---|
| Pressure Difference in Inches Water | Outdoor Airflow Rate (cfm) |
| .1 | 67 |
| .3 | 87 |
| .5 | 103 |
| .7 | 118 |
| 1 | 137 |

With the known relationship between the pressure differential proximate the barometric relief damper and the flow rate through it, one may account for the airflow through the barometric relief damper in setting the needed ventilation through the ventilation vents, or barometric relief damper. In some systems, the pressure differential may be determined directly using pressure sensors across the barometric relief damper. In others, the pressure may be known across the outdoor damper 632 because of a pressure sensor, such as sensor 642 in FIG. 7, and it may be desirable to use that information. In one instance, the variation between the pressure across the outdoor damper and proximate the barometric relief damper may be assumed to be zero. In another embodiment, beginning with the pressure differential across the outdoor damper, a known relationship may be used to better calculate the estimated pressure across the barometric relief damper; for example, the following or other relationship may be used to more accurately estimate the pressure differential:

$$D_{Pbaro}=D_{Pod}+D_{Prd} \quad \text{(Equation 8)}$$

where $D_{Pod}$ is the pressure difference across the outdoor damper and is measured by a sensor. $D_{Prd}$ is the pressure difference proximate the return air damper and is a function of the damper position and the supply fan airflow rate. When the economizer is in the closed position, $D_{Prd}$ is quite small. If more accuracy is desired, $D_{Prd}$ can be estimated using the following equation:

$$D_{Prd}=CA_RD^2*\text{Rho_air}*(\text{Supply_airflow}-\text{ventilization_airflow})^2 \quad \text{(Equation 9)}$$

Where, CA_RD is the damper flow coefficient which can be determined using a lookup table which is a function of damper position;

Rho_air is the density of air and can often be assumed to be 0.075 $lb/ft^3$.

Supply_airflow is supply airflow rate in CFM which is measured by the software;

Ventilation_airflow is outdoor airflow through the outdoor damper.

Figure 9:
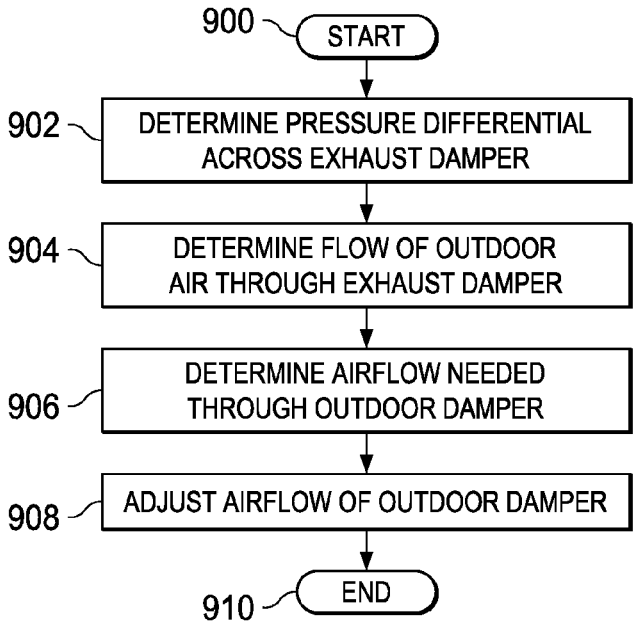
FIG. 9 is a schematic flow chart of a portion of an illustrative process for ventilating a building according to at least some of the principles of the disclosure.

Referring now primarily to FIG. 9, one illustrative embodiment of a process for ventilating a building is presented. The process may be executed by the controller 648 (FIG. 7) or 160 (FIG. 1). The process begins at step 900. A pressure differential at or proximate the exhaust damper is determined at step 902. The known relationship of the pressure differential to the amount of flow through the barometric relief damper is then used to determine the amount of outdoor air entering at 904.

Thus, given an outdoor airflow or ventilation airflow required to meet an air quality standard (includes a desired ventilation), the necessary ventilation 640 through the outdoor damper 632 may be calculated at 906. The equation would be as follows:

(required airflow through the outdoor damper)=(required airflow to meet the standard)−(the amount of outdoor air entering through the barometric relief damper) (Equation 10)

Once the required airflow through the outdoor damper is calculated, the outdoor damper may be adjusted at 908 and the process ends at 910. As used herein, "the amount required by a standard" and like terminology includes a desired level by the operator. If the required airflow through the outdoor damper is calculated to be zero or less, then the outdoor damper is commanded to remain closed.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A method for providing ventilation to a building, the method comprising:

installing a rooftop heating ventilation and air conditioning system comprising:

an economizer comprising an outdoor damper, which is for receiving ambient air from outside the heating ventilation and air conditioning system, and having ventilation vents for receiving ambient air from outside, and having a return damper, and a barometric relief damper for allowing air to exit the rooftop heating ventilation and cooling system when operating in an economizer mode and that allows at least some leakage of ambient air from outside into the heating ventilation and air conditioning system when not in the economizer mode;

determining a pressure differential proximate the barometric relief damper;

determining-a first outdoor airflow leaking into the rooftop heating ventilation and air conditioning system through the barometric relief damper when not in the economizer mode, wherein this step comprises:

determining a pressure differential across the barometric relief damper, and determining the first outdoor airflow leaking into the rooftop heating ventilation and air conditioning system based on the pressure differential proximate the barometric relief damper and based on a relationship between the pressure differential proximate the barometric relief damper and outdoor air entering the barometric relief damper;

subtracting the first outdoor airflow from a minimum outdoor airflow for the building to determine a second outdoor airflow for the outdoor damper; and introducing into the rooftop heating ventilation and air conditioning system through the outdoor damper ambient air from outside the second outdoor airflow.

2. The method of claim 1, wherein the step of introducing into the rooftop heating ventilation and air conditioning system through the outdoor damper ambient air from outside in an amount of the second outdoor airflow comprises adjusting the outdoor damper to obtain the second outdoor airflow based on an established relationship between the pressure differential across the outdoor damper and the flow rate through the outdoor damper.

3. The method of claim 1, wherein the step of determining a pressure differential across the barometric relief damper comprises: using a pressure sensor proximate the outdoor damper to approximate the pressure differential proximate the barometric relief damper.

4. The method of claim 1, wherein the step of determining a pressure differential across the barometric relief damper comprises: determining with a pressure sensor proximate the outdoor damper a pressure across the outdoor damper, $D_{POD}$, and further adjusting the pressure based on an established relationship of pressure proximate the outdoor damper and proximate the barometric relief damper.

5. The method of claim 4, wherein the established relationship of pressure proximate the outdoor damper and proximate the barometric relief damper comprises: $D_{PBaro}=D_{POD}+D_{Prd}$, where $D_{Prd}=DC^2*\rho_{air}*(SupplAir-VenAir)^2$, where DC is a damper coefficient for the outdoor damper and which is a function of damper position, $\rho_{air}$ is the density of air, SupplAir is the supply airflow rate in CFM, VenAir is the outdoor airflow through the outdoor damper and $D_{PBaro}$ is pressure differential across the barometric relief damper.

6. A rooftop heating ventilating and cooling system for providing conditioned air to a building comprising:

an economizer comprising an outdoor damper, which is for receiving outdoor air, and a return damper;

an actuator coupled to the outdoor damper and the return damper for positioning blades of the outdoor damper and the return damper;

a barometric relief damper for allowing air to exit the system when in an economizer mode and allowing at least some outdoor air to leak into the heating ventilating and cooling system through the barometric relief damper when not in an economizer mode;

at least one pressure sensor for measuring a pressure differential across a portion of the economizer;

an evaporator in a conditioning flow path;

a heating element in the conditioning flow path;

a return damper; and a controller associated with the actuator for controlling the outdoor damper and the return damper, wherein the controller includes at least one processor and at least one memory and is configured to:

determine a pressure differential across the barometric relief damper based on data from at least one pressure sensor;

determine a first outdoor flow, which is leaking through the barometric relief damper, based on an established relationship between the pressure differential proximate the barometric relief damper and outdoor air entering the barometric relief damper;

subtract the first outdoor airflow from a minimum outdoor airflow to determine a second outdoor airflow for the outdoor damper;

determine a pressure differential across the outdoor damper based on data from at least one pressure sensor; and adjusting the outdoor damper to obtain the second outdoor airflow based on an established relationship between the pressure differential across the outdoor damper and the flow rate through the outdoor damper to adjust the outdoor damper to obtain the second outdoor airflow.

7. The system of claim 6, wherein the step of determining a pressure differential across the barometric relief damper comprises: using a pressure sensor proximate the barometric relief damper to directly measure the pressure differential proximate the barometric relief damper.

8. The system of claim 6, wherein the step of determining a pressure differential across the barometric relief damper comprises: using a pressure sensor proximate the outdoor damper to approximate the pressure differential across the barometric relief damper.

9. The system of claim 6, wherein the step of determining a pressure differential, $D_{PBaro}$, across the barometric relief damper comprises: using a pressure sensor proximate the outdoor damper to determine a pressure across the outdoor damper, $D_{POD}$, and further estimating the pressure across the barometric relief damper based on an established relationship between pressure proximate the outdoor damper and proximate the barometric relief damper.

10. The system of claim 9, wherein the established relationship of pressure proximate the outdoor damper and proximate the barometric relief damper comprises: $D_{PBaro}=D_{POD}+D_{Prd}$, where $D_{Prd}=DC^2*\rho_{air}*(SupplAir-VenAir)^2$, where DC is a damper coefficient for the outdoor damper and which is a function of damper position, $\rho_{air}$ is the density of air, SupplAir is the supply airflow rate in CFM, and VenAir is the outdoor airflow through the outdoor damper.

* * * * *